US005183174A

United States Patent [19]

Quintero

[11] Patent Number: 5,183,174

[45] Date of Patent: Feb. 2, 1993

[54] SPECIALIZED EAR-HANDLED HOLDER-CONTAINER

[76] Inventor: Dennis E. Quintero, 25 Bon Air Rd., Baltimore, Md. 21225

[21] Appl. No.: 905,813

[22] Filed: Jun. 29, 1992

[51] Int. Cl.[5] ..... B65D 90/04

[52] U.S. Cl. ..... 220/404; 220/909

[58] Field of Search ..... 220/404, 403, 908, 909; 248/97; 229/907, 117.14

[56] References Cited

U.S. PATENT DOCUMENTS

| | | | |
|---|---|---|---|
| 4,576,310 | 3/1986 | Isgar et al. | 220/404 |
| 4,664,347 | 5/1987 | Brown et al. | 220/404 |
| 4,715,572 | 12/1987 | Robbins et al. | 220/404 |
| 4,940,159 | 7/1990 | Callas et al. | 220/404 |
| 4,974,746 | 12/1990 | Dickinson | 220/404 |
| 5,018,637 | 5/1991 | Miller | 220/404 |
| 5,100,087 | 3/1992 | Ashby | 220/404 |

*Primary Examiner*—Joseph Man-Fu Moy

[57] ABSTRACT

A specialized piggy-back container and second holder-container attached to each other. The second holder-container with holder-container ear-handles attached to the upper rim and shaped to receive one or more plastic trash bags with bag handles which are looped over the holder-container ear-handles. The first container is provided with a piggy-back second usually smaller holder-container which is attached to the side of the first container for temporary storage of recyclable material. The second attached holder-container is specially formed handle-ear extensions of the upper holder-container wall for temporarily receiving plastic trash bag handle loops spread over the holder-container handle-ear extensions. This device is additionally provided with a tight or frictional fitting lid so that most of the plastic bag is contained with all of the recyclable material therein is concealed from view and all that is visible is the pleasant appearance of the exterior of the secondary holder-container.

4 Claims, 1 Drawing Sheet

SPECIALIZED EAR-HANDLED HOLDER-CONTAINER

BACKGROUND OF THE INVENTION

This invention relates to containers for recyclable trash waste and other materials that need temporary storage, and more particularly to those containers-brackets or holder-container units formed to have more than one compartment to store the regular trash or garbage. To this unit at least one additional compartment or unit is formed and particularly characterized by two or more handle like ear or bracket extensions of the upper wall periphery for temporarily receiving plastic trash bag and holding it in place by the trash bag handle loops.

In the marketing and production of devices to recycle trash, cans, miscellaneous items, garbage, and other waste materials; various containers have been patented, designed, manufactured and sold. These devices normally are designed as single or multiple containers to receive and contain the waste materials temporarily just in the form they are created.

Examples of some are:

| | |
|---|---|
| D-308,272 | D-312,159 |
| D-310,744 | D-312,522 |
| D-311,801 | D-313,684 |

U.S. Pat. Nos. Des. 312,159 and 312,522 each show a cupboard or cabinet design that could not function and does not teach any functioning, concerning holding specifically sized plastic bag in the open condition. U.S. Pat. No. Des. 313,801 shows a plurality of containers that have foot operated lids arranged in an aggregation of subjectively acceptable pattern for sorting, but under no conceivable skill without using new inventive skills, could the art and appearance of this patent be stretched to cover, the pertinent teachings of specialized use for holding eared bags in an open condition cooperating with a lidded surrounds that make the combination substantially air tight herein. The remaining design patents, namely; U.S. Pat. Nos. Des. 308,272; 310,744; and 311,801 each suffer from the absence of any disclosure of a lidding, a pair of tabs, ears, or handles to hold a bag in the open position.

It is well known that various purveyors or merchandisers of articles of original merchandise, quite often provide free plastic carrying bags for the purveyor and the customer to place the articles of merchandise to be carried. For a particular industry or segment of commerce, the plastic bags are usually of a uniform and consistent size and shape. Further, after the first use, these bags become "a glut on the market", even to the extent that the stores or merchandisers are providing separate containers for the customers to bring back to the store for recycling these once used plastic bags.

Accordingly, it is an object of this invention to provide;

a. A temporary storage bracket for these relatively uniform recyclable plastic bags to be conveniently and sanitarily stored in an bag open position cooperating with the device surrounds to provide a temporary lidding means to keep the contents of the plastic bag from reacting warmly with the air and smelling. This being done selectively adjacent to the regular main trash or waste container or containers, to receive other recyclable material such as aluminum cans or independent of the cans.

b. A convenient eared or ear-handled means of holding at least one plastic bag temporarily, in a controlled open mouth shape, to provide a "held open" plastic holder-container, into which other recyclable can be disposed. This holder-container is preferably but not necessarily located at the customer's preferred regular trash receptacle position. This makes it convenient to place the, to be recycled, material in the plastic bag for further recycling. Once provided by the grocery store, it can now be used for a second time.

c. A sanitary smell resistant or smell proof means of greater stability in combination with the container to which the plastic bag holder-container is attached, than the stability of either the base container alone or the holder-container alone. This provided means of storing one or more plastic storage bags with integral handles, usually from a single merchandising type of source, in a nesting and compact space saving location, adjacent to the regular trash container for serial use as recyclable temporary containers.

d. An effective sanitary means of controlling smell emanating from the recyclable article holder-container through the use of a friction fitting lid that allows soft plastic handles to deform and seal between the lid and the upper periphery of the bag holder-container.

e. A temporary storage place utilizing commerical give away plastic bags.

SUMMARY OF THE INVENTION

This invention relates to a specialized holder-container for trash waste and other materials that need temporary storage, and more particularly to those holder-containers formed to have at least a bracket or means of holding a plastic bag or bags integral with the basic trash container. Thus the first (larger) container is provided with a piggy-back second holder-container with a bracket or means of holding plastic bag or bags usually forming a smaller holder-container attached to the side of the first container. The first container may be or may not formed additionally to be comprised of more than one compartment. The second attached holder-container is formed as a specialized bracket unit, which unit is characterized by handle-ear extensions, projecting upwardly from the upper holder-container wall for temporarily receiving plastic trash bag handle loops spread over the holder-container handle-ear extensions. This second attached holder-container can be used as a stand alone holder container or by means of the usual fastening or attaching means such as adhesives, magnets or hooks and eyes the two devices can be attached to each other.

DETAILED DESCRIPTION OF THE PREFERRED EMBODIMENTS

Figure 1:
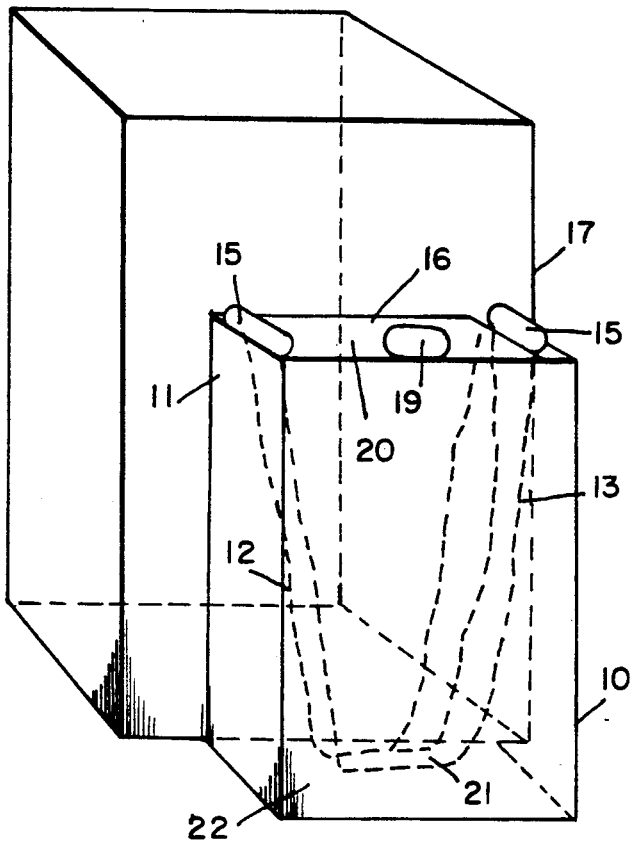
FIG. 1 is a isometric view of the specialized piggy back holder-container, showing a plastic trash bag partly in phantom within the second holder-container.

Referring now to FIG. 1, there is illustrated a specialized piggy-back compartment container 10, showing the second holder-container 11, attached to the side of the first container 17, at attachment line 16. The attachment of one holder-container may be by a removable attachment means or that of a permanent attachment, made in a known manner. One or more plastic trash bags 12, and 13, are provided with handles 14, are placed in the secondary holder-container with the plastic handles 14, looped over the holder-container ears 15. These plastic bags are usually received, free, from the vendor or merchant as a convenience for carrying the customer's purchases from the store, generally, to the purchasers, car then to the purchasers home. After removing the purchases from these temporary vendor supplied plastic bags the bags are usually a problem item of trash disposal. Instead under the teaching of this application, these bags 12, can be placed temporarily in the second plastic bag container 11, by looping the handles 14, around the handle ears 15, of this second plastic bag container 11, individually, or by nesting them, one within the other. The bottom of the second plastic bag supports the bottom of the plastic bag. Both can be done since the bags are usually of substantially the same size within an industry chain. The first container 17, is larger than the second plastic bag 12, container 11.

Figure 2:
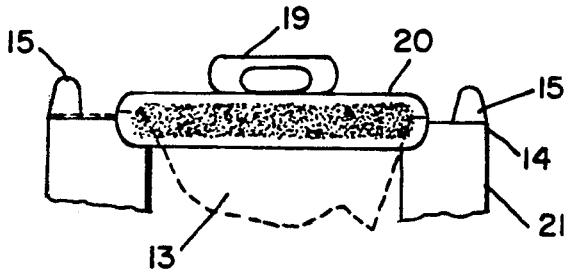
FIG. 2 is a cross sectional view of the lid structure of the eared holder-container.

The specialized multiple containers 10, for recycled waste and other materials that need temporary storage, are formed to have more than one compartment attached to each other to form an integral unit container. Thus the first container 17, is provided with a piggyback second usually smaller holder-container 11, attached to the side of the first container 17. The second attached holder-container 11, is formed as a specialized unit, which unit is characterized by specially formed handle-ear extensions 15, of the upper holder-container wall for temporarily receiving plastic trash bag handle loops 14, spread over the holder-container handle-ear extensions 15. This device is additionally provided with a tight or frictional fitting lid 19, optional handle 19, that can be closed as shown in FIG. 2. As can be seen the bag handles 14, are placed over the ear devices 15, but when the lid is closed the handles are partially under the lid 20, as is the remainder of the plastic bag 13. Thus most of the plastic bag, contained with all of the recyclable material therein, is concealed from view and all that is visible is the pleasant appearance of the exterior of the secondary holder-container.

I claim:

1. An eared integral holder-container means for receiving handled plastic bags, comprising;

a first larger container and a second smaller holder-container bracket means attached to each other at their sides said second holder-container being provided with two ear-handled extensions, projecting upwardly from opposing sides of the upper holder-container wall.

the second holder-container of a size to hold within the holder-container substantially all of the plastic bag, except the bag handles which are spread over the holder-container ear-handles.

a friction fitting lid for the second holder-container, to enclose the holder-container around substantially all of the plastic bag, with the bag handles remaining outside and over the holder-container ear handles to seal against smells.

2. A device as in claim 1 wherein the said second holder-container size is of such a magnitude that the bottom of the plastic bag is supported by the bottom of the second holder-container.

3. A device as in claim 1 wherein the said second holder-container is attached to the larger first container for stability.

4. An eared integral holder-container means for receiving handled plastic bags, comprising;

a holder-container bracket means attachable to an other container at their sides said holder-container being provided with at least two tabs or ear-handled extensions, projecting upwardly from opposing sides of the upper holder-container wall.

the holder-container of a size to hold in open bag position within the holder-container substantially all of the plastic bag, except the bag handles which are spread over the holder-container ear-handles, a lid for the second holder-container, to enclose the holder-container around substantially all of the plastic bag, in sealed condition with the bag handles remaining outside and over the holder-container ear handles to seal against the bag contents smells.

* * * * *